US006467844B1

(12) United States Patent
Gebhard

(10) Patent No.: US 6,467,844 B1
(45) Date of Patent: Oct. 22, 2002

(54) SYSTEM TIGHTENING THE SEAT SUPPORTS OF CHAIRS

(75) Inventor: Reinhard Gebhard, Sulzbach-Rosenberg (DE)

(73) Assignee: Sifa Sitzfabrik GmbH, Sulzbach-Rosenberg (DE)

( * ) Notice: Subject to any disclaimer, the term of this patent is extended or adjusted under 35 U.S.C. 154(b) by 0 days.

(21) Appl. No.: 09/743,835

(22) PCT Filed: Dec. 15, 1998

(86) PCT No.: PCT/DE98/03678

§ 371 (c)(1),
(2), (4) Date: Mar. 14, 2001

(87) PCT Pub. No.: WO00/03622

PCT Pub. Date: Jan. 27, 2000

(30) Foreign Application Priority Data

Jul. 15, 1998 (DE) ..... 298 12 598 U

(51) Int. Cl.[7] ..... A47C 3/00
(52) U.S. Cl. ..... 297/374; 297/300.7
(58) Field of Search ..... 297/374, 300.7

(56) References Cited

U.S. PATENT DOCUMENTS 5,328,242 A * 7/1994 Steffens et al. ..... 297/374
5,423,594 A * 6/1995 Hancock et al. ..... 297/300.2
5,423,595 A * 6/1995 Hancock ..... 297/374
5,676,425 A * 10/1997 Pernicka ..... 297/374
5,685,607 A * 11/1997 Hirschmann ..... 297/301.7
5,863,099 A * 1/1999 Hancock ..... 297/374
6,131,996 A * 10/2000 Gebhard ..... 297/313

FOREIGN PATENT DOCUMENTS

DE 3402147 A1 * 7/1985
WO WO-8602536 A * 5/1986

* cited by examiner

*Primary Examiner*—Peter M. Cuomo
*Assistant Examiner*—Joseph Edell
(74) *Attorney, Agent, or Firm*—Darby & Darby

(57) ABSTRACT

Clamping arrangement for seat carriers of chairs, in particular office swivel chairs, whereby the seat carrier is provided with at least two parts which can be pivoted in relation to each other about a common axis and to each of which a lamellar stack is hinged, whereby the lamellar stacks intermesh with each other, whereby both lamellar stacks are provided with recesses through which they are hinged to a common transverse pin, and the recesses of at least one of the lamellar stacks allow the lamellar stack to move across the axis of the common pin, and whereby means are provided which can be moved into and out of a clamped position with the lamellar blades of both stacks, whereby the clamping means are supported on one of the two parts or another additional part of the seat carrier, and a stop for the lamellar blades is provided in the seat carrier opposite to the clamping direction, whereby clamping means (9) are pivotably arranged in part (1), and its pivoting axis extends across the axis of the common pin (2), whereby means are provided for pivoting the clamping means (9) which extend outside the seat carrier and can be activated from outside, whereby furthermore in cross section, the clamping means have a contour which in axial direction of the common pin (2) has at least two different thicknesses, and whereby finally the clamping means are provided with at least two surfaces (15, 17) arranged at an angle to each other, one of which surfaces (15), when in clamped position, abuts to and clamps the lamellar blades (7) or a flange or collar acting upon said blades, whereby this one surface (15) constitutes the inner end of the thicker contour.

6 Claims, 5 Drawing Sheets

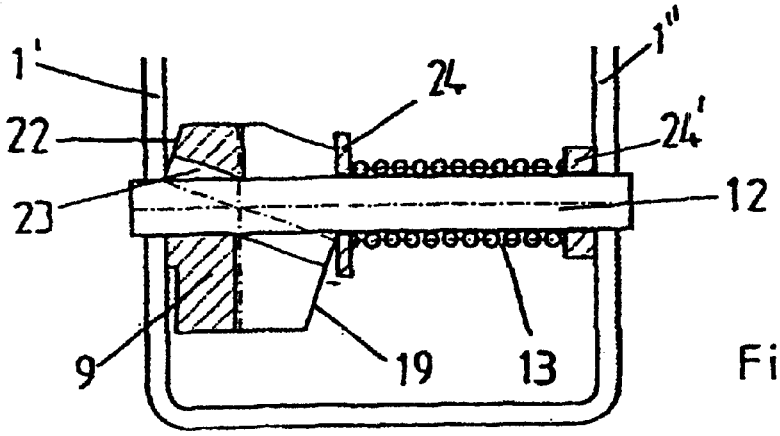
Fig.5
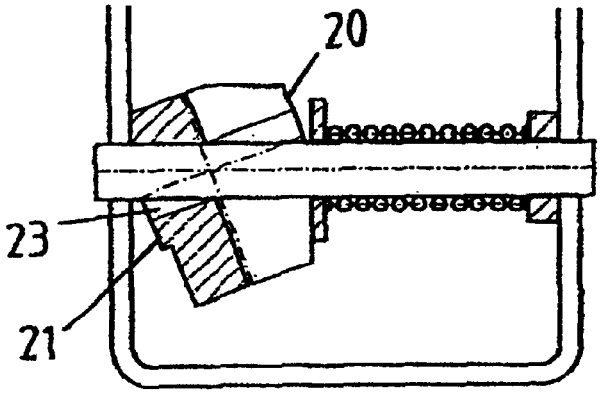
Fig.6
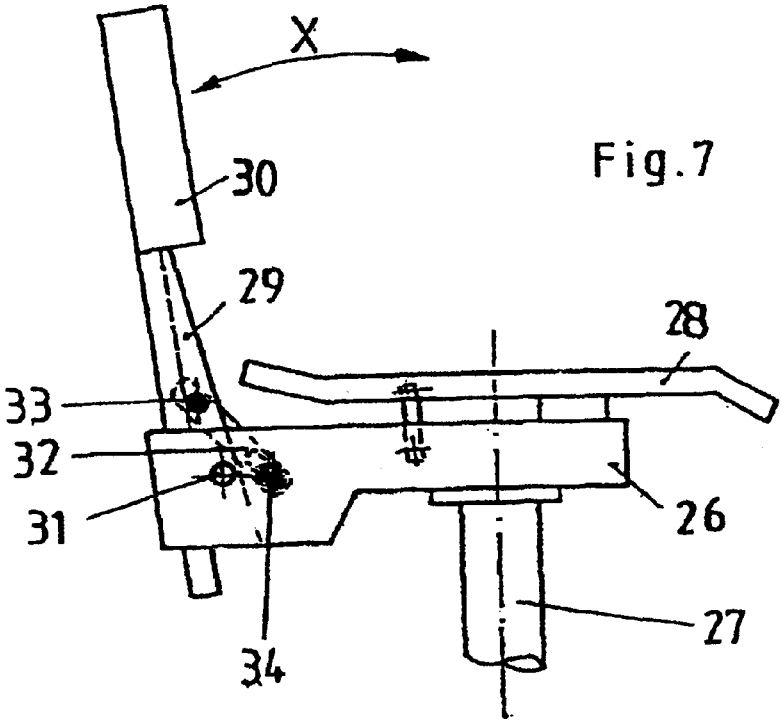
Fig.7
Fig.8
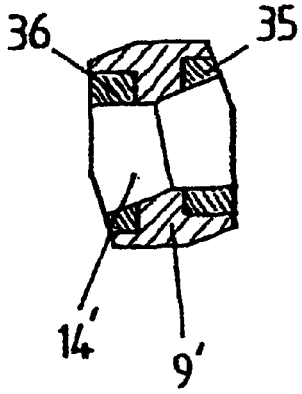

SYSTEM TIGHTENING THE SEAT SUPPORTS OF CHAIRS

This application is a National Stage application under 35 U.S.C. 371 of international patent application number DE98/03678, now published as WO 00/03622.

BACKGROUND OF THE INVENTION

The present invention relates to a clamping arrangement for seat carriers of chairs, in particular office swivel chairs, with the characteristics of the generic part of Claim 1.

A clamping arrangement for seat carriers of chairs, in particular office swivel chairs, whereby the seat carrier is provided with at least two parts which can be pivoted in relation to each other about a common axis and to each of which a lamellar stack is hinged, whereby the lamellar stacks intermesh with each other, whereby both lamellar stacks are provided with recesses through which they are hinged to a common transverse pin, and the recesses of at least one of the lamellar stacks allow the lamellar stack to move across the axis of the common pin, and whereby means are provided which can be moved into and out of a clamped position with the lamellar blades of both stacks, whereby the clamping means are supported on one of the two parts or another additional part of the seat carrier, is known, for example, from DE-U-295 02 040. The two parts which can be pivoted in relation to each other are the base structure which rests on the support column with the pedestal and the back rest carrier, whereby the clamping mechanism is supported in the base part. The clamping means are designed as a cylindrical plastic roller with flattened zones. When the full diameter of the roller engages between an exterior wall of the base part and a stop for the lamellar blades, the latter are clamped. It was found that clamping, which takes place substantially along two lines, is not satisfactory in every case.

OBJECTS AND SUMMARY OF THE INVENTION

The objective of the present invention is to develop a clamping arrangement of the type mentioned earlier to the effect that the a clamping state can be achieved which is secure and permanent, and that users physically perceive the adjustment from clamping to unclamping as they operate the arrangement.

According to the invention, a clamping arrangement of the type mentioned earlier is characterized in that the clamping means are pivotably arranged in the part, whereby their swivel axis extends across the axis of the common pin, so that means for the pivoting of the clamping means are available which extend outside the seat carrier and can be activated from the outside, and that the clamping means are provided with at least two surfaces arranged at an angle to each other, one of which, when in clamped position, abuts to and clamps the lamellar blades or a flange or collar acting upon said blades.

According to an advantageous embodiment of the invention, the clamping means are an elongated clamping body whose longitudinal axis is parallel to the lamellar blades, whereby the clamping body is provided with a drilled hole, which becomes conically wider on both sides, for the common pin or a sleeve surrounding same, whereby the surfaces arranged at an angle to each other are parallel to the longitudinal axis of the lamellar blades and whereby the clamping body is provided with a drilled hole for a pivot arm rigidly connected with same which extends outside the seat carrier on that side of the clamping body which faces away from the lamellar blades. At a distance from the lamellar stacks, the clamping body is provided with a second drilled hole, which becomes conically wider on both sides, and is mounted with this second drilled hole on a retaining pin arranged parallel to the common pin in the seat carrier. On the retaining pin, a compression spring is arranged which applies a force to the clamping body opposite to the clamping direction.

For example, the clamping body can be supported in the seat carrier against the force of a spring; preferably, however, it consists of a molded plastic part, whose side opposite the lamellar blades is supported by support surfaces on a side wall of a part of the seat carrier, whereby each support surface is parallel to one of the surfaces arranged at an angle to each other.

According to a preferred embodiment of the invention, the common pin and the retaining pin are arranged in the side walls of a part of the seat carrier with a U-shaped cross section, and the clamping body is supported on one side of the interior wall of the part, whereby the lamellar blades, when in clamped position, are pressed against the other interior wall or against a stop rigidly connected to it or to the common bolt.

Preferably, there are two surfaces arranged at an angle to each other and two support surfaces, whereby the surfaces arranged at an angle to each other and the support surfaces enclose obtuse angles of equal size, so that when the clamping body is pivoted about its longitudinal axis from one pair of surfaces to the other, the apical lines press simultaneously against the interior wall and the lamellar blades or against a flange acting upon the blades, thus making the adjustment physically perceivable.

According to a special embodiment of the invention, the common bolt is surrounded by a slidingly mounted sleeve which is provided with a flange, whereby in clamped position the clamping body presses upon the flange, and the flange abuts to the lamellar stacks, whereby the lamellar stacks on the other side abut to a stop which is rigidly connected to the common pin, and whereby a spring is provided which is supported on the stop and which has a tendency of pressing the sleeve against the clamping direction.

BRIEF DESCRIPTION OF THE DRAWINGS

The above, and other objects, features and advantages of the present invention will become apparent from the following description read in conjunction with the accompanying drawings, in which like reference numerals designate the same elements.

FIG. 5 shows a sectional view along line II—II of FIG. 9 in an unclamped position;

FIG. 6 shows a sectional view along line IV—IV of FIG. 3 in clamped position;

FIG. 7 shows the top part of a schematic view of an office swivel chair;

FIG. 8 shows a section through a special embodiment of a clamping body;

DETAILED DESCRIPTION OF THE INVENTION

Figure 1:
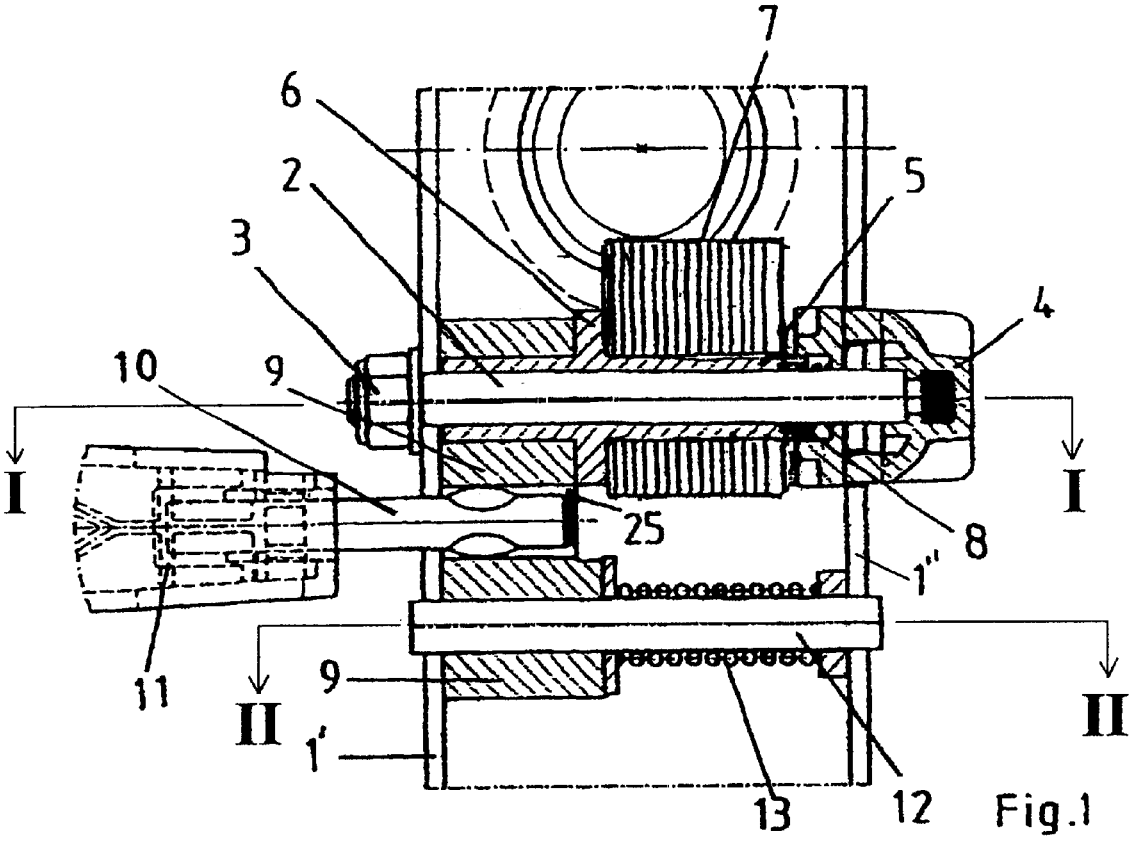
FIG. 1 shows a top view of a base structure of a seat carrier with the clamping arrangement according to the invention, in unclamped position.
Figure 2:
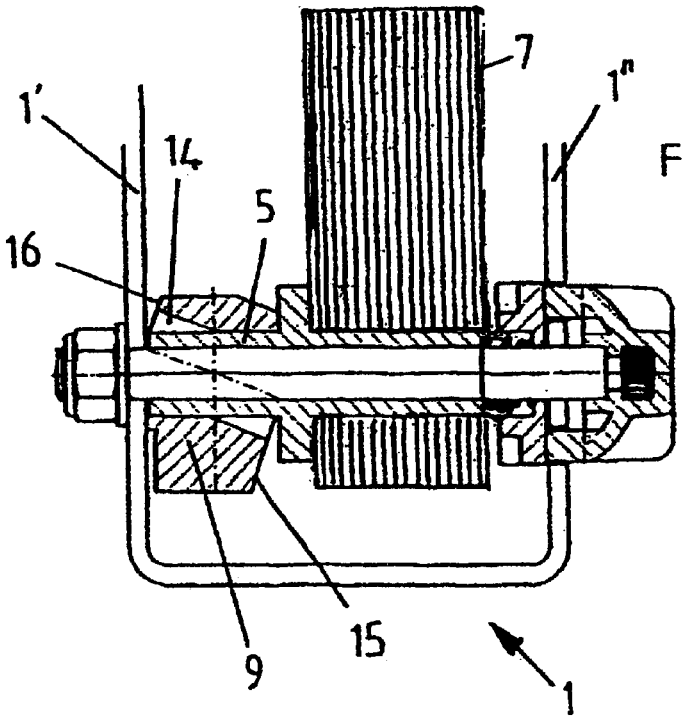
FIG. 2 shows a sectional view along line I—I of FIG. 1 and indicates a section through the lamellar stack and the clamping arrangement for same in an unclamped position.
Figure 3:
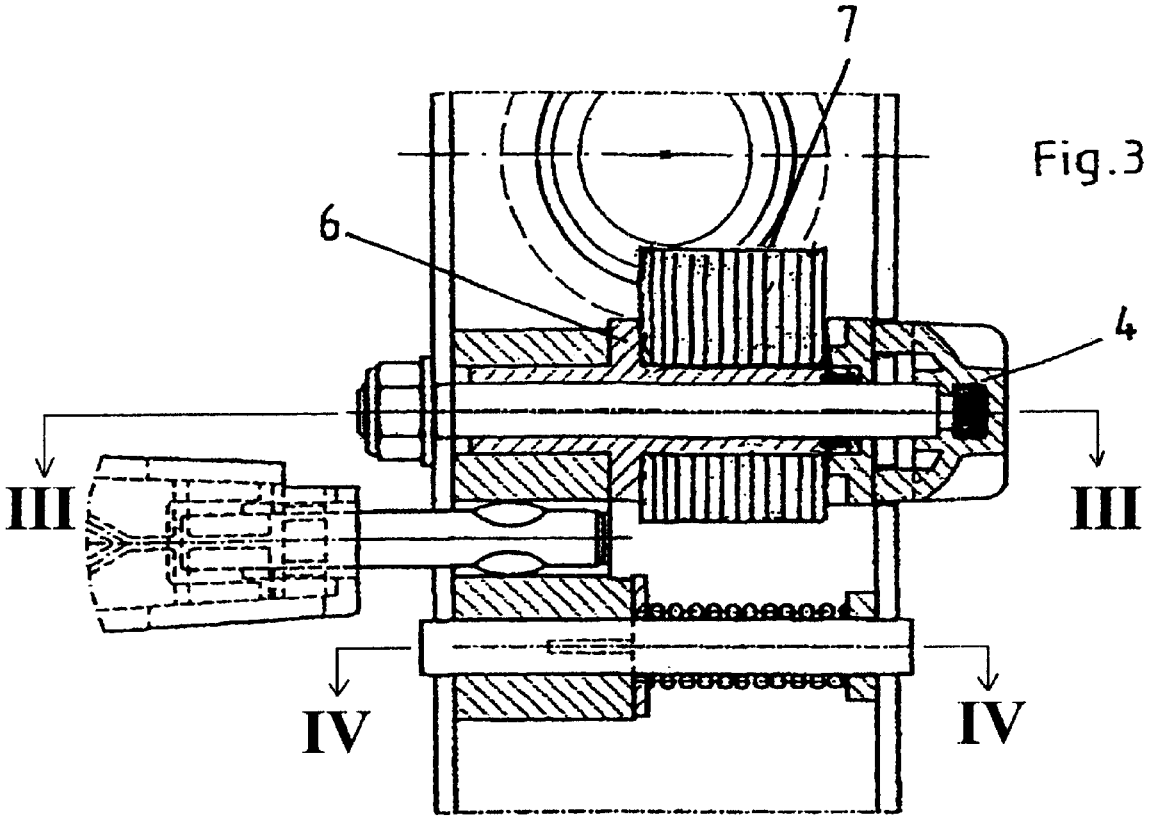
FIG. 3 shows a top view of a base structure of the seat carrier with the clamping arrangement in a clamped position.
Figure 4:
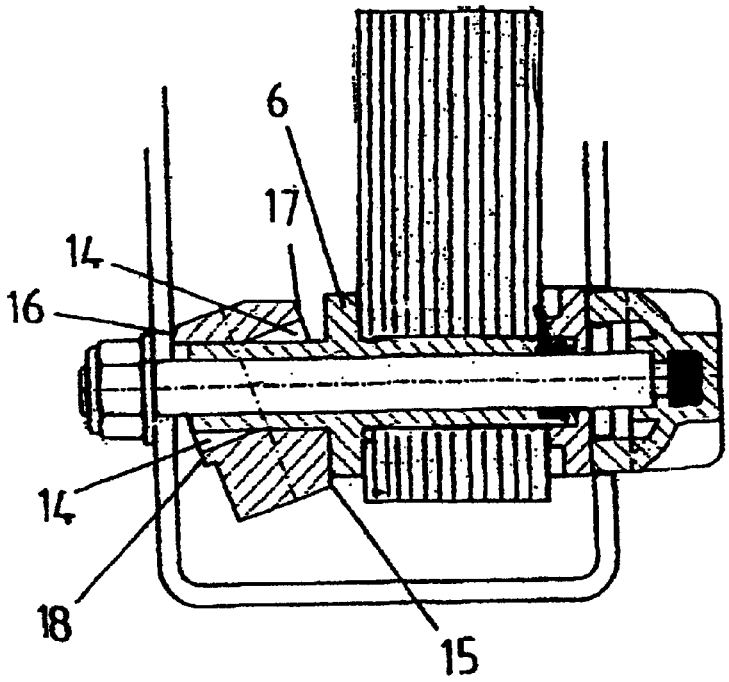
FIG. 4 shows a sectional view aline line III—III of FIG. 3, and indicates a clamped position.

FIG. 1 to 4 show a base structure 1 of a seat carrier of an office swivel chair having a U-shaped cross section with two side walls 1', 1", between which the clamping arrangement according to the invention is accommodated. On a common pin 2, held between walls 1', 1", a stack of mutually intermeshing lamellar blades 7 is mounted on a sleeve 5. As known in prior art, some of these lamellar blades are provided with drilled holes which correspond to the outer diameter of sleeve 5, while others are provided with elongated holes with which they can slide on the sleeve by a certain path. These particular lamellar blades 7 are linked at the other end to a back seat carrier (not shown) which is pivotably connected to the base structure. The common pin 2 is held on one end in a stop and mounting bracket 4 which is rigidly connected to the end of the common pin 2 and held in an opening in wall 1" and on the other end screwed from the outside with a nut 3 to the other wall 1'. Sleeve 5 is slidingly mounted on pin 2 and is provided with a flange 6 that surrounds it. Lamellar stack 7 is arranged between flange 6 and stop and mounting bracket 4. Spring 8 is supported in bracket 4 and bears against the adjacent end of sleeve 5. On the other side of flange 6, a clamping body 9 is arranged between it and wall 1'. Clamping body 9 is an elongated molded plastic part that extends from the common pin 2 to a retaining bolt 12, which is arranged in the same plane at a distance to same between walls 1', 1" of base structure 1. Clamping body 9 is provided with recesses 14 and 23 (FIG. 5 and 6) for sleeve 5 surrounding pin 9 and for the retaining bolt, which recesses become conically wider on both sides and are dimensioned so that clamping body 9 can be tilted about sleeve 5 and retaining pin 12. To allow this tilting motion, an arm 10 between pin 2 and retaining pin 12 is rigidly held in a drilled hole 25 of clamping body 9 and extended outside through wall 1' which has a large enough opening for this tilting movement, and there, the arm is connected to a handle 11 by which the arm can be moved back and forth between two positions. These two positions are the clamped position and the unclamped position of the clamping arrangement. Clamping body 9 is provided with two pairs of surfaces which enclose an obtuse angle between each other, whereby one pair of surfaces 15, 17 is aligned with flange 6 and the other pair 16. 18 with wall 1'. The opposite surfaces 15, 16 and 17, 18 are parallel to each other. Since the transition of the conical widenings of recesses 14, 23 are mostly arranged above the longitudinal middle plane of clamping body 9, it happens that the distance between surfaces 15 and. 16 is greater than the distance between surfaces 17 and 18. Therefore, when clamping body 9 is aligned by means of arm 10 in such a way that surface 18 abuts to wall l' as shown in FIG. 2, there is play between flange 6 and stop and mounting bracket 4 which makes intermeshing lamellar blades 7 freely movable. When the clamping body is moved by means of arm 10 into the clamped position shown in FIG. 4, surface 16 on one side abuts to wall 1", and the parallel surface 15 on the other side presses upon flange 6, which causes lamellar blades 7 to be pressed together and against stop and mounting bracket 4. This results in a positive frictional connection, and the lamellar blades are clamped in a certain position.

Figure 9:
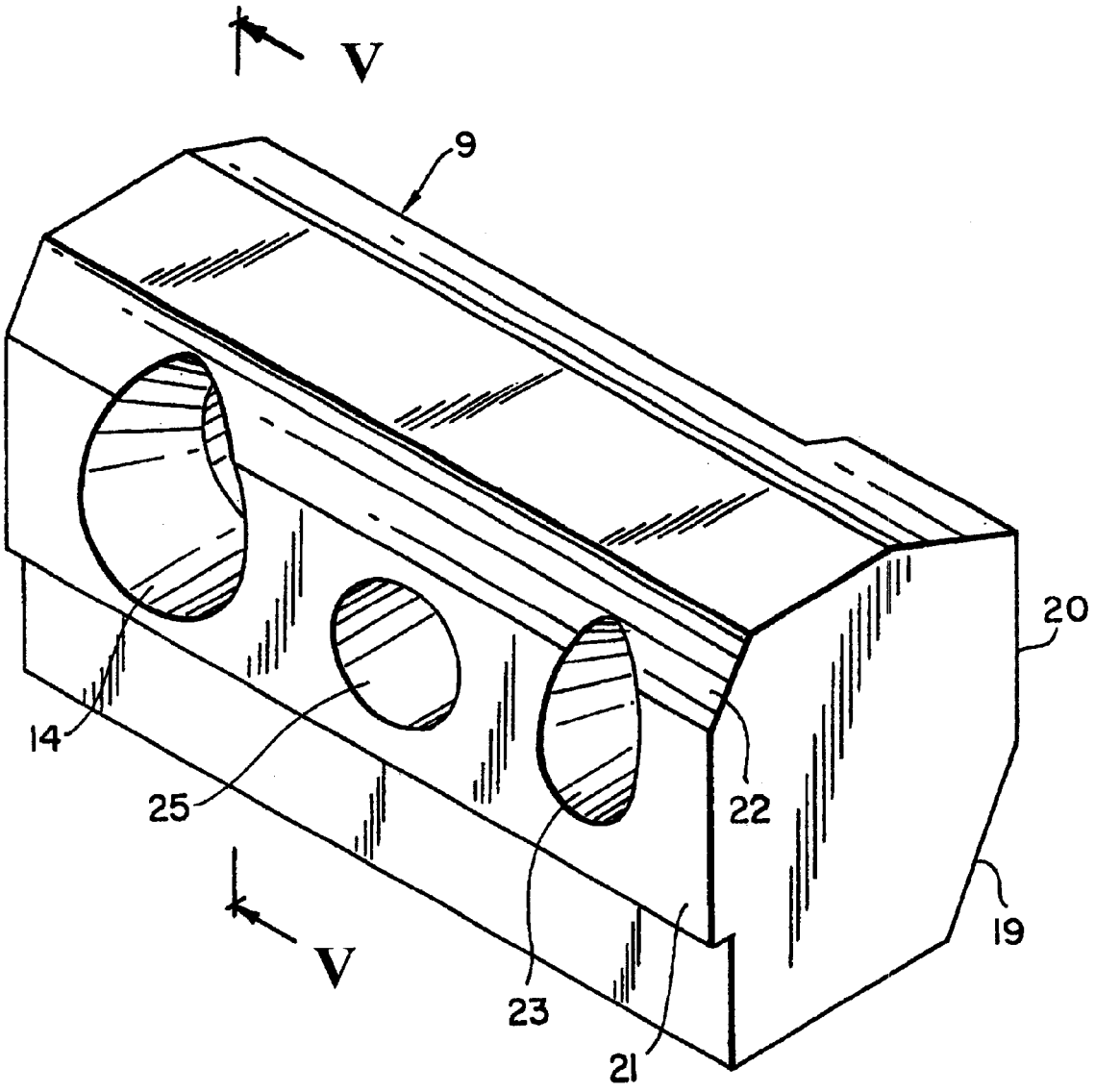
FIG. 9 is a perspective view of the clamping body.
Figure 10:
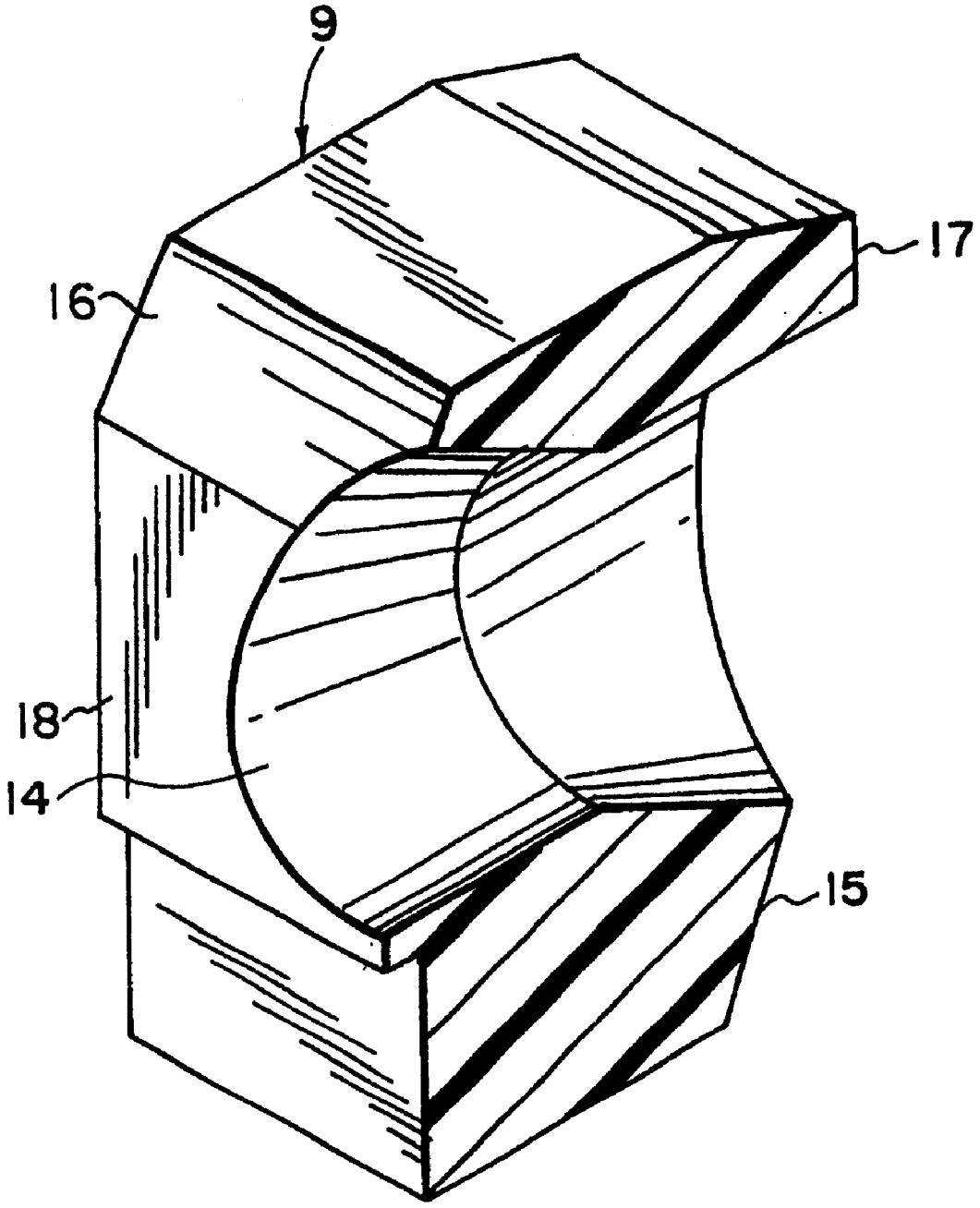
FIG. 10 shows a sectional view along line V—V of FIG. 9.

As shown in FIG. 5 and 6, clamping body 9 in the area of retaining pin 12 performs an identical movement for the reasons outlined above, whereby the surfaces with the greater distance from each other are surfaces 19 and 22 and those with the lesser distance from each other are surfaces 20 and 21. Recess 23, which widens conically on both sides, is longer in the direction of wall 1", since clamping body 9 is thicker there. In the area of retaining pin 12, clamping body 9 does not perform a clamping function, but—depending on the tilting position—is subjected more or less to a force applied by compression spring 13 which is mounted on the retaining pin and supported between two rings 24 and 24' on clamping body 9 on one side and wall 1" on the other side. The purpose of this spring 13 is to support the adjusting movement between one and the other pair of surfaces of clamping body 9 as well as to provide a certain stability to the respective position of clamping body 9. FIGS. 9 and 10 are respectively a perspective view of body 9 and a cross sectional view through line V—V in FIG. 9.

As an example, FIG. 7 shows the arrangement of the clamping arrangement according to the invention in an office swivel chair. The chair has a seat carrier with a base structure 26 on which a support column 27 is held that is connected to a pedestal (not shown). Arranged on base structure 26 is a seat platform 28, and a back rest carrier 29 is pivotably connected by means of a transverse pin 31 to the rear end of the base structure. Back rest carrier 29 carries a back rest 30. Arranged between back rest carrier 29 and the base structure are lamellar blades 32 which are rotatably hinged to the back rest carrier, but rigidly linked to a transverse pin 33 and mounted rotatably and in non-stationary fashion to a transverse pin 34 of the base structure. Between two lamellar blades, at this latter transverse pin, which corresponds to the above described clamping arrangement, stationary lamellar blades are mounted on transverse pin 34, thus resulting in the above described lamellar stack. The above described clamping arrangement engages at this pin 34; the details described above are not shown in this example.

Clamping body 9' in FIG. 8 is an advantageous embodiment in which, in addition to recess or recesses 14', inserts 35, 36 are provided, which are made of an elastic or non-slip material which improves the secure application of clamping body 9' to interior wall 1' of the seat carrier or to sleeve 6 and/or disc 24, whereby even small tolerances can be equalized if the inserts slightly protrude beyond clamping body 9'.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A seat carrier of chairs, comprising:

first and second parts which can be pivoted in relationship to each other about a common axis, the first part being a back seat carrier, the second part being a base structure, said base structure having a U shaped cross section with two opposite side walls;

a common pin extending transversely between and through both said side walls;

a sleeve having a first end and a second end slidably engaging the pin and having a flange disposed between the first end and second end; one of the first end and second end of said sleeve having a stop;

first and second laminar stacks of laminar blades which intermesh, said stacks being hinged to said first part and having recesses by which said stacks are hinged to said sleeve, the recesses of at least one of said stacks permitting the said one of said stacks to move transversely across said sleeve, said stacks being disposed between said flange and said stop;

an elongated clamping body pivotally supported in said second part and being manually movable between a first clamped and a second unclamped position relative to said laminar blades of both said stacks;

said body having a longitudinal axis which defines a swivel axis which extends across an axis defined by said pin;

said body in cross section having a contour portion, which in the direction of the axis defined by said pin is provided with at least a first thickness in said first clamped position and at least a second thickness in said second unclamped position; and said body is provided with at least two flat surfaces arranged at an obtuse angle to each other, one of said surfaces engaging said flange when said swivel axis is in said first clamped position, said other of said surfaces engaging said flange when said swivel axis is in the second unclamped position.

2. The seat carrier of chairs according to claim 1, wherein:

said clamping body has an elongated clamping body whose longitudinal axis is substantially parallel to said lamellar blades;

said clamping body has a drilled hole which becomes conically wider on both sides, for one of said common transverse pin and a sleeve surrounding said common transverse pin; and said clamping body has a pivot arm drilled hole, rigidly connecting to a pivot arm, said pivot arm, on a side of said clamping body facing away from said lamellar blades, extends outside said seat carrier.

3. The seat carrier of chairs according to claim 2, wherein:

said clamping body, at a distance from said lamellar stacks, has a second drilled hole mounted on a retaining pin; and said retaining pin being substantially parallel to said common transverse pin of said seat carrier.

4. The seat carrier of chairs according to claim 3, further comprising:

a compressing spring, on said retaining pin, applying a force upon said clamping body opposite to a clamping direction.

5. The seat carrier of chairs according to claim 1, wherein said clamping body is supported against a force of a spring.

6. In a seat carrier of chairs which makes use of: first and second parts which can be pivoted in relationship to each other about a common axis, the first part being a back seat carrier, the second part being a base structure, said base structure having a U shaped cross section with two opposite side walls; and further making use of: a common pin extending transversely between and through both said side walls, a sleeve having a first end and a second end slidably engaging the pin and having a flange disposed between the first end and the second end and first and second laminar stacks of laminar blades which intermesh, said stacks being hinged to said sleeve having recesses by which said stacks are hinged to said sleeve, the recesses of at least one of said stacks permitting the said one of said stacks to move transversely across said sleeve, said stacks being disposed between said flange and a stop; the improvement which comprises:

an elongated clamping body pivotally supported in said second part and being manually movable between a first clamped and a second unclamped position relative to said laminar blades of both said stacks;

said body having a longitudinal axis which defines a swivel axis which extends across an axis defined by said pin;

said body in cross section having a contour portion, which in the direction of the axis defined by said pin is provided with at least a first thickness in said first clamped position and at least a second thickness in said second unclamped position; and said body is provided with at least two flat surfaces arranged at an obtuse angle to each other, one of said surfaces engaging said flange when said swivel axis is in said first clamped position, said other of said surfaces engaging said flange when said swivel axis is in the second unclamped position.

* * * * *